United States Patent [19]

Palmer

[11] Patent Number: 5,004,362

[45] Date of Patent: Apr. 2, 1991

[54] MECHANICAL PENCIL

[76] Inventor: Leon Robert Palmer, 81 Pennsylvania Ave., Somerset, Mass. 02726

[21] Appl. No.: 529,584

[22] Filed: May 29, 1990

[51] Int. Cl.[5] ..... B43K 21/22

[52] U.S. Cl. ..... 401/53; 401/67; 401/103

[58] Field of Search ..... 401/103, 59, 65, 66, 401/67, 53

[56] References Cited

U.S. PATENT DOCUMENTS

| | | | |
|---|---|---|---|
| 1,737,862 | 12/1929 | Morris | 401/53 |
| 1,745,658 | 2/1930 | Becker | 401/53 |
| 2,469,411 | 5/1949 | Robbins | 401/53 X |
| 2,865,330 | 12/1958 | Swank | 401/103 |
| 3,514,211 | 5/1970 | Hashimoto | 401/53 |

*Primary Examiner*—Richard J. Johnson

[57] ABSTRACT

A mechanical pencil which employs the concept of inverting the configuration of a conventional mechanical pencil by designating the depressible end as the writing end and the stationary end as the eraser and thereby providing the convenience of advancing the lead as required without interrupting the writing process and requiring slightly more than the effort of dotting the letter "i" or adding a period at the end of a sentence.

Such a mechanical pencil is provided with a simple and unique lead-advancing device comprising of a plurality of equally opposing pivotally fastened spring loaded spring clip mechanisms which, when activated by quickly applying and releasing slightly greater than normal writing pressure once to the depressible end against a writing surface, are caused to simultaneously lift away from the lead, extend and regrasp the lead at a higher position then pull the lead to advance it to a predetermined length, suitable for writing with, during the contraction of the mechanisms to their rest position.

7 Claims, 7 Drawing Sheets

MECHANICAL PENCIL

BACKGROUND

This invention relates to mechanical pencils, specifically to a new internal lead advancing mechanism which pulls the lead to advance it instead of pushing the lead.

Conventional mechanical pencils require the writing process to be interrupted and the hand to change position for regrasping the pencil to enable the thumb to reach to and depress the eraser end three to four times to advance the lead to a desirable length for writing. The hand must then be repositioned to regrasp the pencil comfortably to resume writing. These conventional mechanical pencils are provided with an internal push-type chuck mechanism which is caused to push the lead to advance it simultaneously as the depressible end is depressed which necessitates the pencil to be lifted away from the writing surface to allow space for the lead to advance.

The applicant's invention is provided with a simple and unique lead-advancing device comprising of a plurality of equally opposing pivotally fastened spring-loaded spring clip mechanisms which, when activated by quickly applying and releasing slightly greater than normal writing pressure once to the depressible end against a writing surface, are caused simultaneously lift away from the lead, extend and regrasp the lead at a higher position then pull the lead to advance it to a predetermined length, suitable for writing with, during the contraction of the mechanisms to the their rest position.

The lead is caused to advance to a predetermined length equal to approximately three or four advances of a conventional mechanical pencil which is sufficient for writing yet short enough to reduce the chance of breakage during writing.

Thus a person can conveniently advance the lead to a predetermined sufficient length with a single push against the writing surface with slightly greater than normal writing pressure without ever changing the writing position of the hand and without interrupting the writing process.

BRIEF DESCRIPTION OF THE DRAWINGS

The advantages of the invention will become more apparent from the specification taken in conjunction with the accompanying drawings in which.

The regrasp of the to spring clips onto the lead to advance it is now impending.

Figure 1:
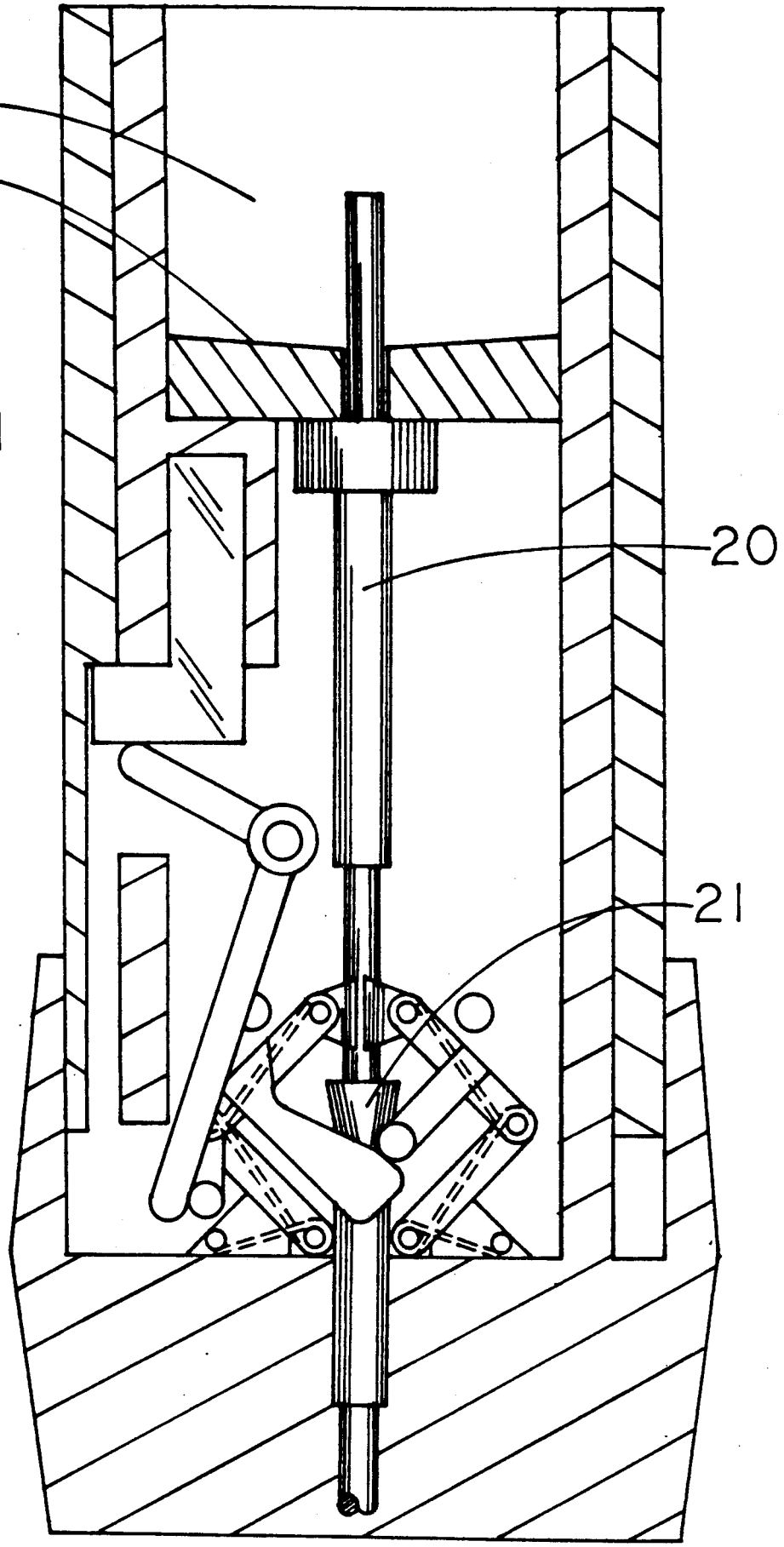
FIG. 1 is a view of the internal components of the mechanical pencil with the spring-loaded spring clip mechanisms in their rest position and bearing against the lead to secure it in place during the writing process.
Figure 4:
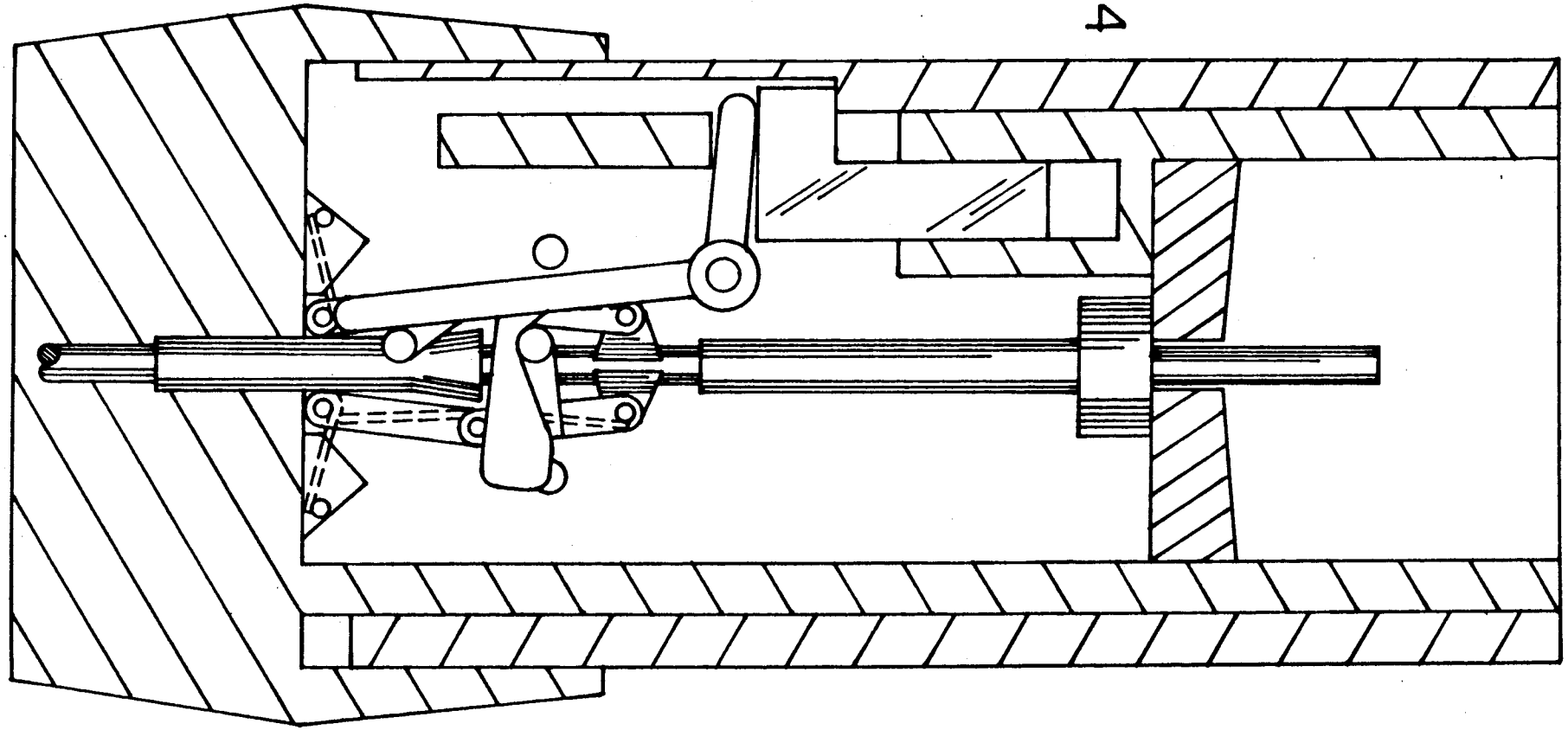

FIG. 4, the same view of the internal components of the mechanical pencil, depicts the initial step of advancing the lead. The downward force is released from the external slidable-sleeve causing the spring clips to regrasp the lead at their extended position. The torsion spring mounted onto each spring clips is in progress of contracting and causing spring clips to continue to bear against and pull the lead to advance it. The entire mechanical system continues to contract with the torsion springs until the rest position of FIG. 1 is achieved.

Figure 5:
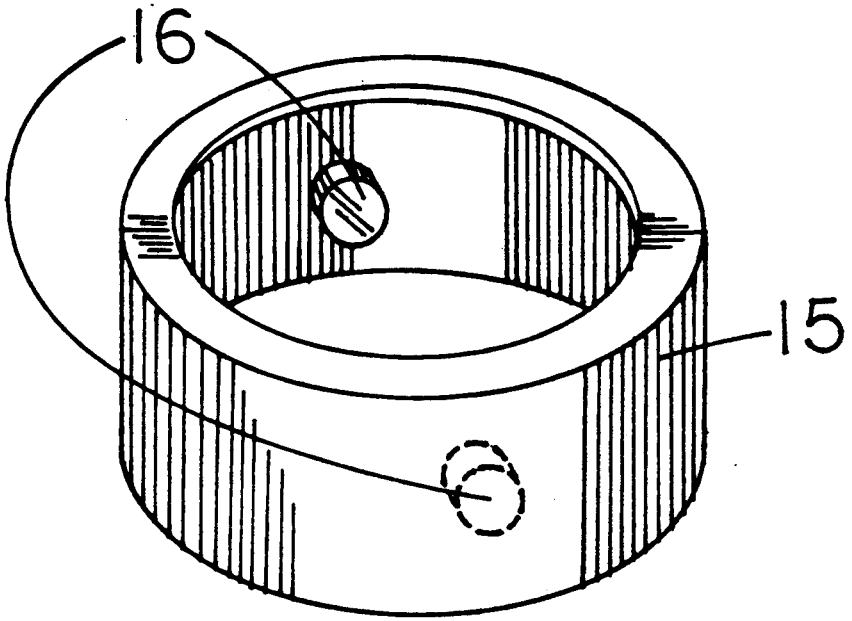

FIG. 5 shows the locking collar with a plurality of posts molded perpendicular to the inside surface. The locking collar must be pushed down to slide the posts out of the vertical channel then turned left or right to capture posts into the horizontal channel which locks the lead-advancing spring clip mechanisms into extended and open position for replenishing the lead supply or retracting the lead into the pencil for storage into a person's pocket.

Figure 6:
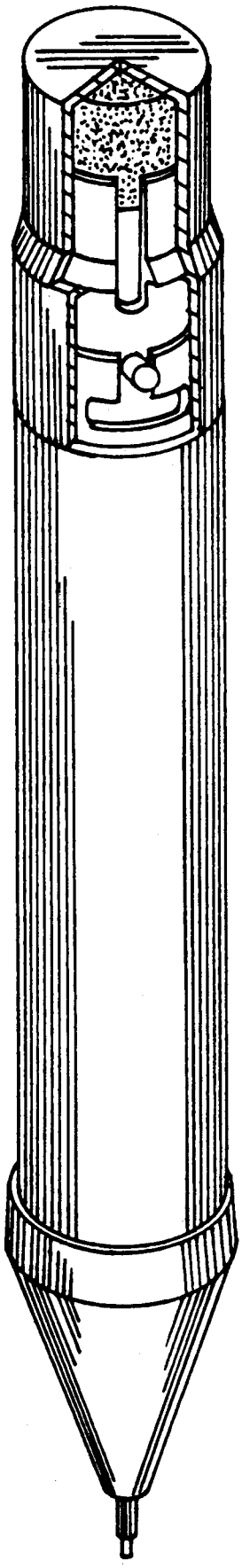

FIG. 6, illustrates the details of the eraser-end of the mechanical pencil. A section of the locking collar is removed to expose the inverted "T" shaped channel molded into the body of the pencil. One of the plurality of posts of the locking collar is shown contained in the vertical section of the inverted "T" channel. The post is presented unattached to the inside surface of the locking collar and suspended in the vertical section of the inverted "T" shaped channel in order to display the movement of the post in the channel. With the posts of the locking collar contained in the vertical section of the channel, the lead-advancing spring clip mechanisms are contracted and bearing against the lead to secure the lead in place during the writing process.

Figure 7:
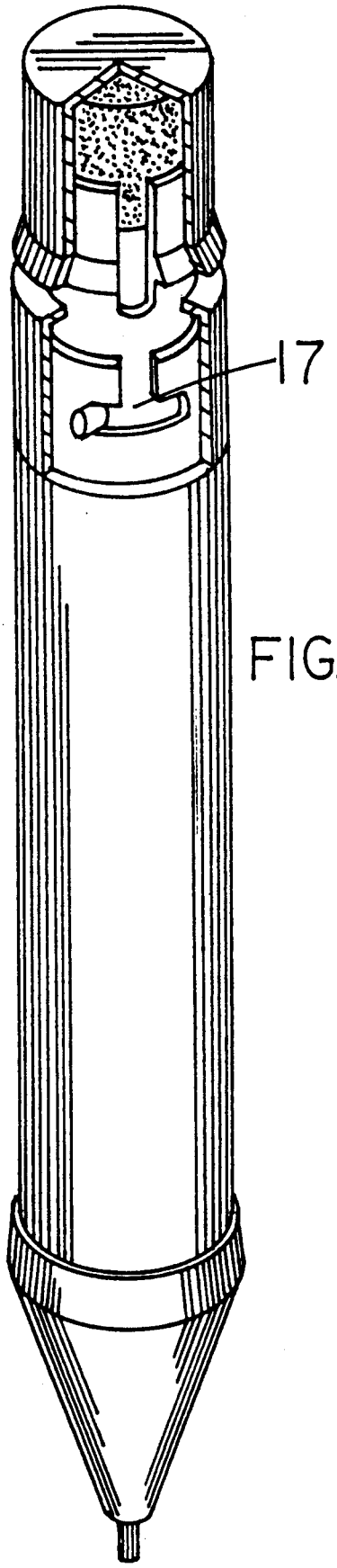

FIG. 7, depicts the same details of the eraser end of the mechanical pencil with the section of the locking collar removed to expose the inverted "T" shaped channel and the suspended post as FIG. 6, but with the post captured in the horizontal section of the channel. With the posts of the locking collar captured in the horizontal section of channel the spring clip mechanism are locked into open and extended position to enable the lead to be retracted back into pencil for storage of the pencil into a person's pocket.

Figure 8:
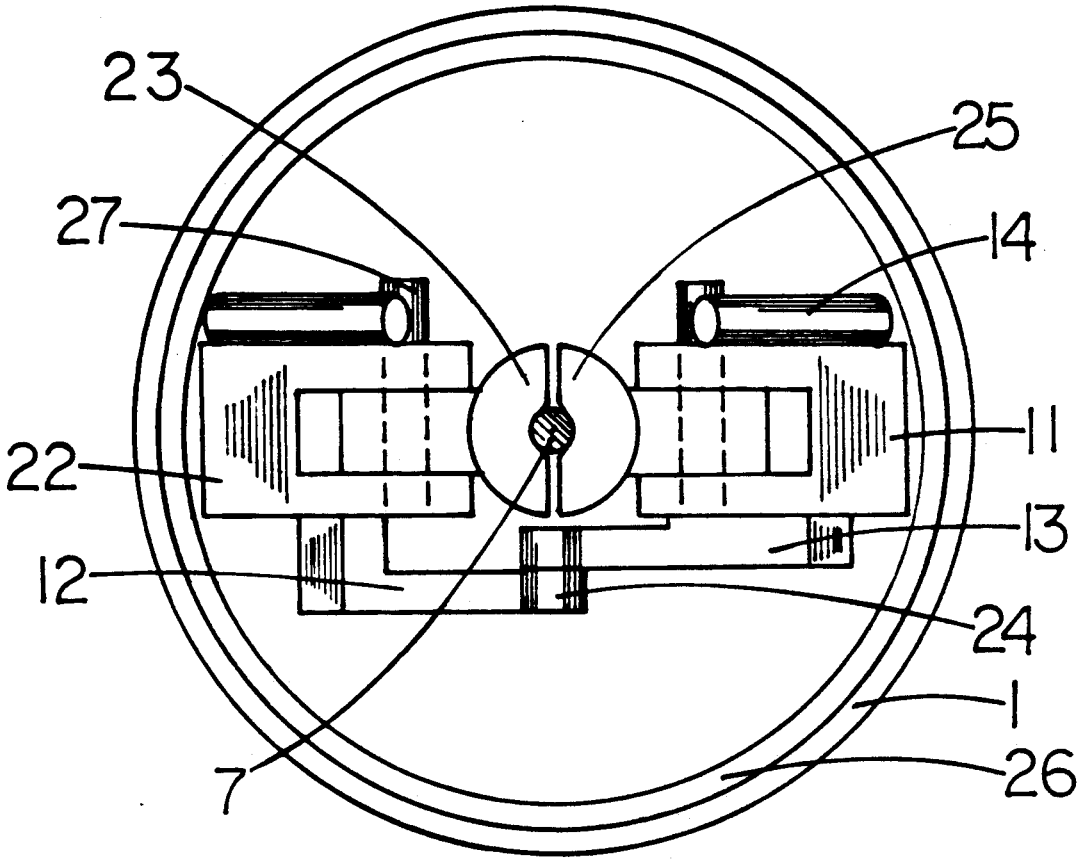

FIG. 8 is a cross-sectional view of the internal pencil showing the external longitudinally slidable sleeve 1 and pencil body 26 and looking down on the leader spring clip 22 in rest position with its arm-like extension 12 and pivotally attached lead-gripper 23 bearing up against the lead 7 to retain lead firmly in place by the contraction force of spring; equally opposing is the follower spring clip 11 with its arm-like extension 13 and cylindrical projection 24 bearing on the arm-like extension of the leader spring clip; pivotally attached to the follower spring clip, with pin 27, is lead-gripper 25 bearing against the lead with equally opposing force from spring 14. Shaded section on either spring clip indicate downward sloping.

Figure 9:
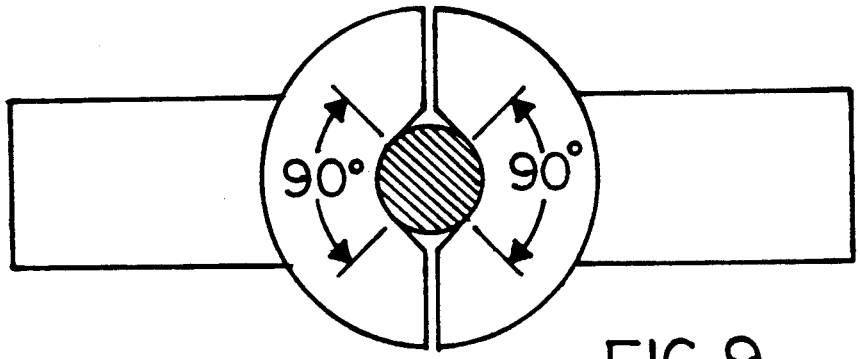

FIG. 9 is an enlarged view of the lead-grippers (unattached to the spring clips) bearing against the lead each with approximateky 90 degrees of circumferential surface contact and angled lead-ins tangentially blending in on both sides of each semi-circular contour for self-centering of the lead-grippers around the lead during regrasping just prior to actual lead advancement.

DESCRIPTION OF THE PREFERRED EMBODIMENT

Figure 2:
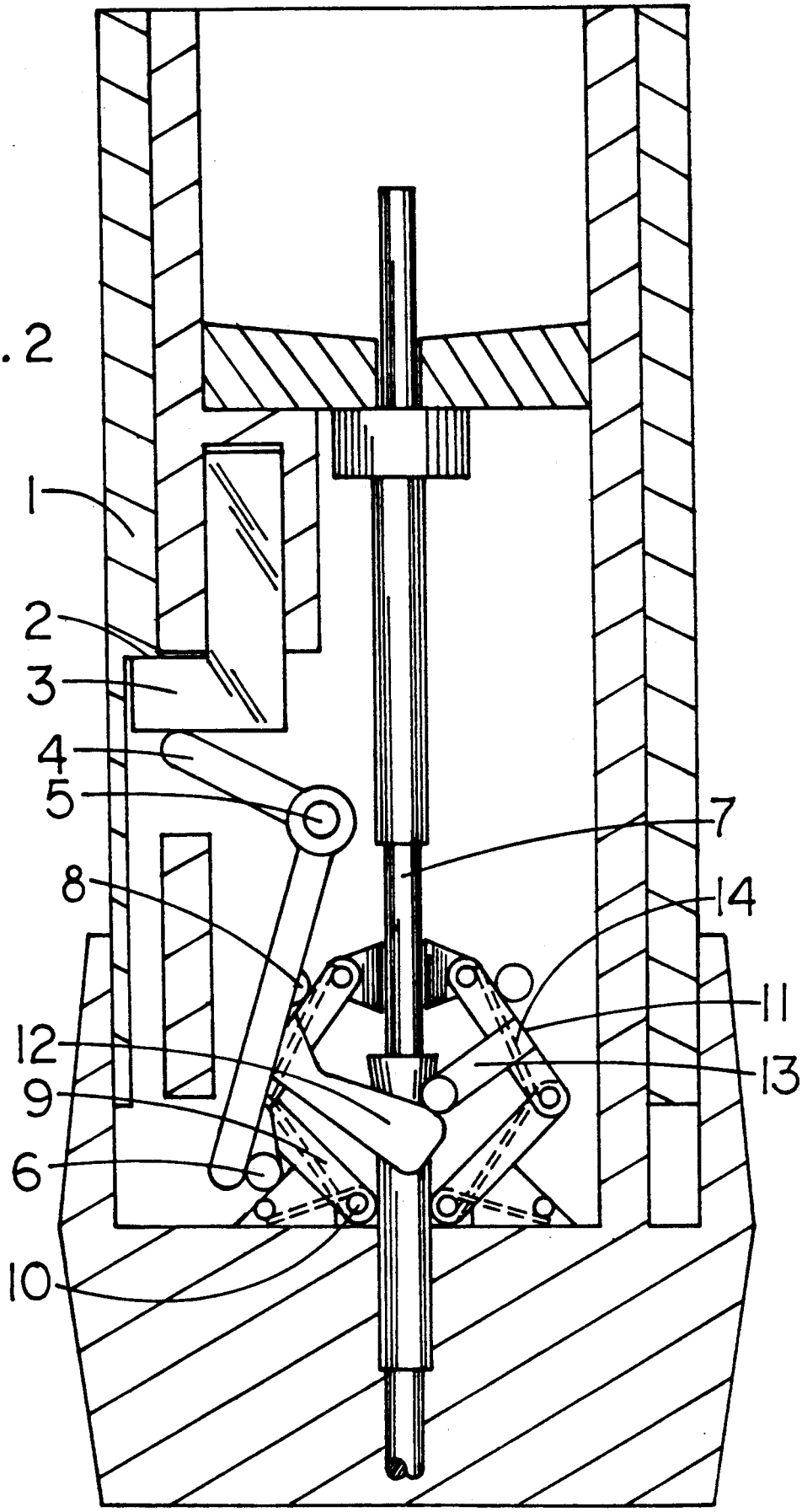
FIG. 2 is the same view of the internal components of the mechanical pencil as FIG. 1 but illustrates the initial motion of applying downward force to the external slidable sleeve. The slider and short-arm of the driver lever are pushed down slightly and the long-arm of the driver lever has pushed the tail of the leader spring clip causing the driver and follower spring clip to lift away from the lead.
Figure 3:
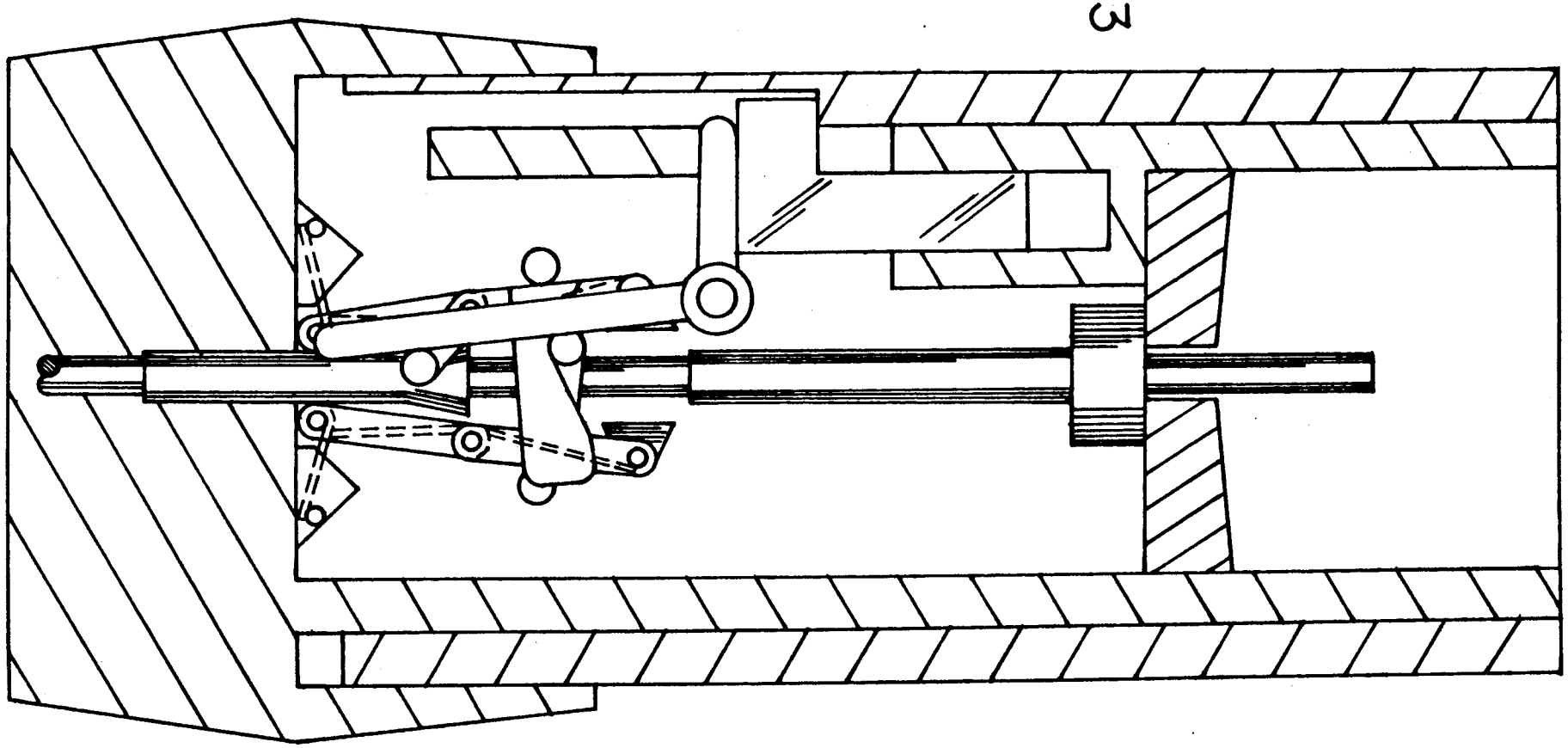
FIG. 3, the same view of the internal components of the mechanical pencil as FIG. 1 depicts the position of each movable component at the fully extended stage of the spring clip mechanisms just prior to the release of the downward force from the external slidable-sleeve.

Advancing the lead requires the mechanical pencil to be held in writing position with the depressible writing-end forced against a writing surface. In FIG. 2 the external longitudinally slidable sleeve 1 is forced downward causing surface 2 to push down on slider 3 and the shorter arm of the driver-lever 4, which pivots about post 5 causing the longer arm of said driver-lever to push on tail of spring-loaded lead advancer leader spring clip 6 causing said leader spring clip to lift away from lead 7 and slide against guide post 8 while extender 9 is caused to pivot upwards about post 10 to provide upward extension to the lead advancer spring clip as shown in FIG. 3 enabling it to grasp lead at a higher position as shown in FIG. 4. Like a mirror-image the lead advancer follower spring clip mechanism 11 duplicates and is controlled by the motion of the leader spring clip by means of leader arm 12 and follower arm 13 of FIG. 2.

As the downward force is quickly removed from the external longitudinally slidable sleeve the leader and follower spring clips simultaneously regrasp the lead at their extended position. It is the return motion of the leader and follower spring clip mechanisms to their rest position that causes the lead to advance. That is; the torsion spring 14 of FIG. 2 mounted to both spring clip mechanisms are caused to extend during the extension motion of the spring clip mechanisms then contract to force the spring clips to bear against the lead at the higher position then pull on the lead to advance it as the entire spring-loaded mechanism, as shown in FIG. 8, once against returns to its rest position with the lead-grippers 23,25 firmly bearing against the lead 7; the bearing force being provided by torsion springs 14 and transmitted through pins 27 and cylindrical projection 24 of follower arm 13 bearing on leader arm 12.

For clarity, FIG. 9 is an enlarged view of the lead-grippers bearing against the lead each with approximately 90 degrees of circumferential surface contact and angled lead-ins tangentially blending in on both sides of each semi-circular contour for self-centering of the lead-grippers around the lead during regrasping just prior to actual lead advancement.

Retracting the lead back into the pencil for storing the pencil into a person's pocket requires that the spring clip mechanisms be maintained in their open or extended position with no grasp on the lead and thereby allowing the lead to be pushed back into the pencil. To maintain the longitudinally slidable sleeve in down position and the spring clip mechanisms in open position a locking collar 15 to FIG. 5 is provided at the eraser end of pencil. Said locking collar is provided with a plurality of short cylindrical posts 16 molded perpendicular to the inside wall of locking collar. Said posts are permanently contained in a plurality of identical inverted "T" shape channels molded into the external surface of the pencil body. These inverted "T" shape channels are shown as 17 of FIG. 6. The locking collar is required to be pushed down to move the plurality of posts out of the vertical section of channels then turned either way horizontally to retain the posts and cause the spring clip mechanisms to be maintained in open position. The retained posts prevent the spring-loaded spring clip mechanisms from contracting and thus the lead from advancing.

Replenishing the lead supply into the pencil requires that the pencil be held in writing position and the writing end pressed against a writing surface. Again, the locking collar must be adjusted as described above to lock the spring clip mechanisms in open position. The lead supply is inserted into and gravity-fed from the lead storage compartment 18 to FIG. 1 located at the eraser end. The floor of lead storage compartment has a sight downward-slope-to-the center conical feature 19 with a round center opening having a diameter approximately 0.005 inches greater than the lead diameter whereby one lead at a time is allowed to enter the center opening then free-fall down through the upper lead-guide tube 20 then between the lead advancer spring clip mechanisms and into the flared-end of the lower lead-guide tube 21 having an inside diameter approximately 0.001 inches larger than the lead diameter to provide a snug slip-fit condition to prevent the lead from falling gravitationally out of pencil when the spring clips are locked into open position during storage of pencil into a person's pocket.

While the above description contains many specifities, the reader should not construe these as limitations on the scope of the invention, but merely as exemplifications of a preferred embodiment thereof. Those skilled in the art will envision many possible mechanisms within the scope.

The applicant claims:

1. A mechanical pencil provided with a lead-advancing device comprising of a plurality of separate and equally opposing spring clip mechanisms pivotally fastened for extendability and bearing against the lead with pivotally attached lead grippers for advancing and retaining said lead in place firmly during the writing process; one of said spring clip mechanisms serving as a leader and provided with a mechanical means to cause the remaining mechanisms to serve as its follower and perform a mirror-image of its motions as the said leader and follower spring clip mechanisms are caused simultaneously to pivotally lift away from bearing on exactly opposite sides of lead, pivotally move to their extended-most position for regrasping the lead at the higher position and advance the lead as the spring-loaded set of mechanisms contract to their rest position; the extension motion of the leader and follower spring clip mechanisms being caused by a pivotally fastened driver-lever whose shorter arm is forced downward by sliding contact against the bottom flat surface of a slider which serves as an extension of the bearing surface in the recessed section in the inside wall of the external longitudinally slidable sleeve; the longer arm of said driver-lever bearing with sliding contact on the cylindrical projection of the tail section of the leader spring clip for causing the lead advancing mechanisms to simultaneously lift away from the lead, extend and regrasp the lead then contract and thereby advance the lead to a suitable writing length beyond the pencil tip with a single pressing of the writing tip against a writing surface without interrupting of the writing process and thereby eliminating the need for the writing hand to change position in order to reach to and depress the opposite end of pencil to advance the lead.

2. The leader spring clip mechanisms of claim 1, in rest position and spring-loaded to bear against the lead, comprises an extender bar pivotally fastened at the base and propped up against a flat positive-stop surface sloped upward and outward away from the center of the pencil; the elevated free end of said extender bar being pivotally fastened to the fulcrum of the leader spring clip whose tail is provided with a cylindrical projection at its end for bearing against with sliding contact by the longer arm of the driver-lever; the leader spring clip provided with a lead gripper pivotally fastened for bearing against the lead during lead advancement and retaining the lead firmly in place during the writing process; the said mechanical means is provided on the leader spring clip to cause the remaining mechanism to serve as its follower and perform mirror-image motions of itself, is an arm-like extension approximately perpendicular to an at the midpoint of the leader spring clip for the arm-like extension of the follower spring clip to bear on with sliding contact during the pivotal extension of the mechanisms to their extended-most position.

3. The follower spring clip mechanism of claim 1, in rest position and spring-loaded to bear against the lead exactly opposite the leader spring clip, comprises an extender bar pivotally fastened at the base and propped up against a flat positive-stop surface sloped upward and outward from the center of pencil; the elevated free-end of extender bar pivotally fastened to the end of the follower spring clip, which has no tail because the arm-like extensions on both spring clips eliminate the need for a second driver-lever for the purpose of reducing the amount of components; a lead-gripper is pivotally fastened to the follower spring clip to provide an equally opposing bearing force on the lead as the lead-gripper of the leader spring clip; the follower spring clip is provided with an arm-like extension approximately perpendicular to and at its midpoint with a cylindrical projection at its free end for bearing with sliding contact on the top surface of the arm-like extension of the leader spring clip and thereby causing the follower spring clip mechanism to perform an exact mirror-image motion of the leader spring clip mechanism during its elevation to the extended-most position and its contraction to the rest position; a guide post is positioned close behind the leader and follower spring clips for guiding both mechanisms toward their extended most position immediately after both spring clips become pivotally lifted away from lead.

4. The lead-grippers of claim 1 pivotally fastened to the leader and follower spring clips are provided with semi-circular contours to conform to the circumference of the lead and with angled lead-ins on both sides of the semi-circular contour and tangentially blending with the semi-circular contour for self-centering around the lead as the lead-grippers, while at the extended-most position of the leader and follower spring clip mechanism, advance toward the lead to regrasp it and thereby maintain circumferential surface contact during the lead advancement and for firmly retaining the lead in place during the writing process.

5. The driver-lever of claim 1 is intentionally configured such that the external downward force, applied to the longitudinally slidable sleeve and transmitted through the slider while the tip of pencil is pressed against a writing surface, is applied to the shorter arm of the driver-lever and the work of activating the spring-loaded spring clip mechanisms is performed by the longer arm of the driver-lever for creating a mechanical disadvantage and thereby preventing an accidental reoccurring nuissance lead advancement while applying normal writingpressure during the writing process; secondly, the shorter arm of driver-lever requires a short longitudinal push of the slidable sleeve to complete its pivotal arc-of-motion while the longer arm pivots through its required longer arc-of-motion to cause the spring clip mechanisms to reach their extended-most position.

6. The lead advancing spring clip mechanisms of claim 1, while in their extended-most position just prior to regrasping the lead at the higher position for advancing it, by virtue of the pivotal motions of their mechanical configurations provides a beneficial fraction-of-a-second delay int he actual advancement of the lead; firstly, at their extended-most position the leader and follower spring clips initially require only horizontal movement to advance toward and regrasp the lead then a combination of horizontal and vertical components of motion are required during the actual advancement; secondly, both extender bars pivotally returning to their rest position require a horizontal component of motion which is much larger than the vertical component, lastly, the inside diameter of the lower lead-guide tube being approximately 0.001 inches larger than the lead diameter provides a slip-fit resistance to prevent the lead from falling gravitationally out of the pencil during storage in a person's pocket when the spring clip mechanisms are locked into open position, offers the same resistance to the advancement of the lead and thereby allows time for the pencil to be lifted away from the writing surface to allow the lead to advance and prevent lead marks, paper gauging and lead breakage on the writing surface.

7. The pencil of claim 1 provided with a mechanical means at the eraser end comprising a plurality of inverted "T" shaped channels molded into the body of pencil for permanently containing one of a plurality of cylindrical posts molded perpendicular to the inside wall of a cylindrical shaped locking collar; said posts remain in the vertical second of said inverted "T" channels during the writing and lead advancing process and must be forced downward and contained into the horizontal sections of inverted "T" channels for maintaining the leader and follower spring clip mechanisms into their extended-most position and thereby enabling the lead to be pushed back into the pencil for storage of the pencil into a person's pocket; said locking collar being easily installed onto the pencil by aligning the posts of locking collar with the slots of the pencil body at the eraser end and pushed beyond the flexible feature for retaining locking collar onto pencil.

* * * * *